US007134915B1

(12) United States Patent
Tsai

(10) Patent No.: US 7,134,915 B1
(45) Date of Patent: Nov. 14, 2006

(54) BASE STRUCTURE FOR COMMUNICATION MODULE

(75) Inventor: Nelson Tsai, Sijhih (TW)

(73) Assignee: Superworld Electronics Co., Ltd., Tao Yuan Shien (TW)

( * ) Notice: Subject to any disclaimer, the term of this patent is extended or adjusted under 35 U.S.C. 154(b) by 0 days.

(21) Appl. No.: 11/304,735

(22) Filed: Dec. 16, 2005

(51) Int. Cl.
*H01R 13/66* (2006.01)
*H01R 33/945* (2006.01)

(52) U.S. Cl. ..... 439/620; 439/676

(58) Field of Classification Search ..... 439/620, 439/676, 540.1, 608
See application file for complete search history.

(56) References Cited

U.S. PATENT DOCUMENTS 6,302,741 B1 * 10/2001 Fasold et al. ..... 439/620.19
6,786,776 B1 * 9/2004 Itano et al. ..... 439/676
6,840,817 B1 * 1/2005 Chen ..... 439/676
6,848,943 B1 * 2/2005 Machado et al. ..... 439/607
2005/0282442 A1 * 12/2005 Hyland et al. ..... 439/676

* cited by examiner

*Primary Examiner*—Tulsidas C. Patel
*Assistant Examiner*—Vladimir Imas
(74) *Attorney, Agent, or Firm*—Troxell Law Office, PLLC

(57) ABSTRACT

A base structure of a communication module comprising a left and a right base part symmetrically arranged and connecting mutually, wherein two engaging grooves are provided respectively at the bottom of the left base part and at the top of the right base part, and comprising two mutually symmetrically and conversely arranged connecting pin sets formed from multiple bent and grouped metallic wire conductors, two inclined connecting pin sets are respectively provided on the front ends of the grouped metallic wire conductors to contact plug pins, a horizontal middle section and a vertical section of each group of metallic wire conductors is enveloped thereover respectively with a horizontal and a vertical plate made of insulating material. The vertical plates are inserted respectively into the engaging grooves; in this way, the communication module can be fast assembled.

6 Claims, 5 Drawing Sheets

BASE STRUCTURE FOR COMMUNICATION MODULE

BACKGROUND OF THE INVENTION

1. Field of the Invention

The present invention is related to a base structure for a communication module, and especially to an improved base structure for a communication module in a stacked connector inserted with RJ-45 network-line plugs to get an effect of fast assembling the communication module.

2. Description of the Prior Art

RJ-45 network-lines are used in a large amount presently for data transmitting. Two ends of each RJ-45 network-line are provided each with a plug having multiple pins (generally 8 pins); the plug can be inserted into a connector for data transmitting.

In the structure of a connector, one or multiple communication modules are assembled on a seat and then the modules and the seat are covered with a metallic housing for shielding. As to the structure of each of the communication modules, basically a wave filtering coil is provided in an insulation base; the insulation base is provided at the front side of it with multiple inclined and elastic connecting pins. In composing the connector, these connecting pins are extended into holes matched respectively with plugs of the RJ-45 network-lines by shape on the seat, and can be contacted with the pins on the inserted plugs to thereby get electric conductive connection.

By the fact that data transmitting has been more and more required from day to day, stacked connectors have been designed and developed. In order to save space, a communication module in a stacked connector has two sets of connecting pins arranged at an upper and a lower position at the front side of an insulation base to be inserted into holes of a seat. The holes of the seat are in the shapes for insertion of an upper and a lower plug, pins on the two plugs are respectively contacted and electrically connected with the two sets of connecting pins for data transmitting.

FIG. 1 shows the interior structure of a conventional communication module in a stacked connector, wherein a wave filtering coil is provided in a space 911 sealed by a circuit board for getting functions of wave filtering and insulating abnormal voltage to protect the communication module from damage. In the conventional structure of the communication module, two side pin boards 908 with arciform pins 910 to be contacted with the pins of an RJ-45 network-line plug are respectively inserted into two engaging grooves 904 of two protruding boards 902, the arciform pins 910 protrude respectively out of two slots 905, the side pin boards 908 and the engaging grooves 904 are very small structures for assembling in comparison with human fingers, assembling for them is very difficult and time consumptive.

Moreover, two lower pin boards (not shown) is mounted in two sets of lower receiving recesses 906 of a main body (divided into two parts 901), this renders the structure unstable and subjected to separating.

SUMMARY OF THE INVENTION

In view of the above stated, the present invention provides a brand-new base structure of a communication module. The base structure comprises a left and a right base part mutually connecting and symmetrically arranged, two engaging grooves are provided respectively at the bottom of the left base part and at the top of the right base part, and comprises two sets of mutually symmetrically and conversely arranged connecting pins, the connecting pins are formed from multiple bent and grouped metallic wire conductors, two inclined connecting pin sets are respectively provided on the two front ends of the grouped metallic wire conductors to contact with plug pins, a horizontal middle section of each group of metallic wire conductors is enveloped thereover with a horizontal plate made of insulating material, a vertical section of each group of metallic wire conductors is enveloped thereover with a vertical plate also made of insulating material. The two vertical plates on the two grouped metallic wire conductors are inserted respectively into the two engaging grooves provided at front sides of the left and the right base parts, in this way, the communication module can be fast assembled.

The base structure of the communication module of the present invention uses the two engaging grooves symmetrically arranged and provided at the front sides of the left and the right base parts to assemble the two vertical plates of the two metallic wire conductors, this makes the operation of assembling easier and faster, thus can increase the rate of production and ratio of superiority, and the cost of production can be lowered.

And more, the present invention has pins embedded in the left and the right base parts, it no more needs to have the two lower pin boards mounted in the lower receiving recesses as is the case of the conventional communication module. Thereby this structure is more stable than the conventional structure and is not subjected to separating.

Moreover, when the communication module of the present invention are assembled on the seat of the connector, by virtue that the two horizontal plates on the two connecting pin sets slide along sliding ways formed in the sockets of the seat for assembling, the structure of an entire stacked connector having the communication module is firmer, the structure can afford inserting of two plugs from the front face of the connector.

The present invention will be apparent in its structural features and functions after reading the detailed description of the preferred embodiment thereof in reference to the accompanying drawings.

DETAILED DESCRIPTION OF THE PREFERRED EMBODIMENT

Figure 1:
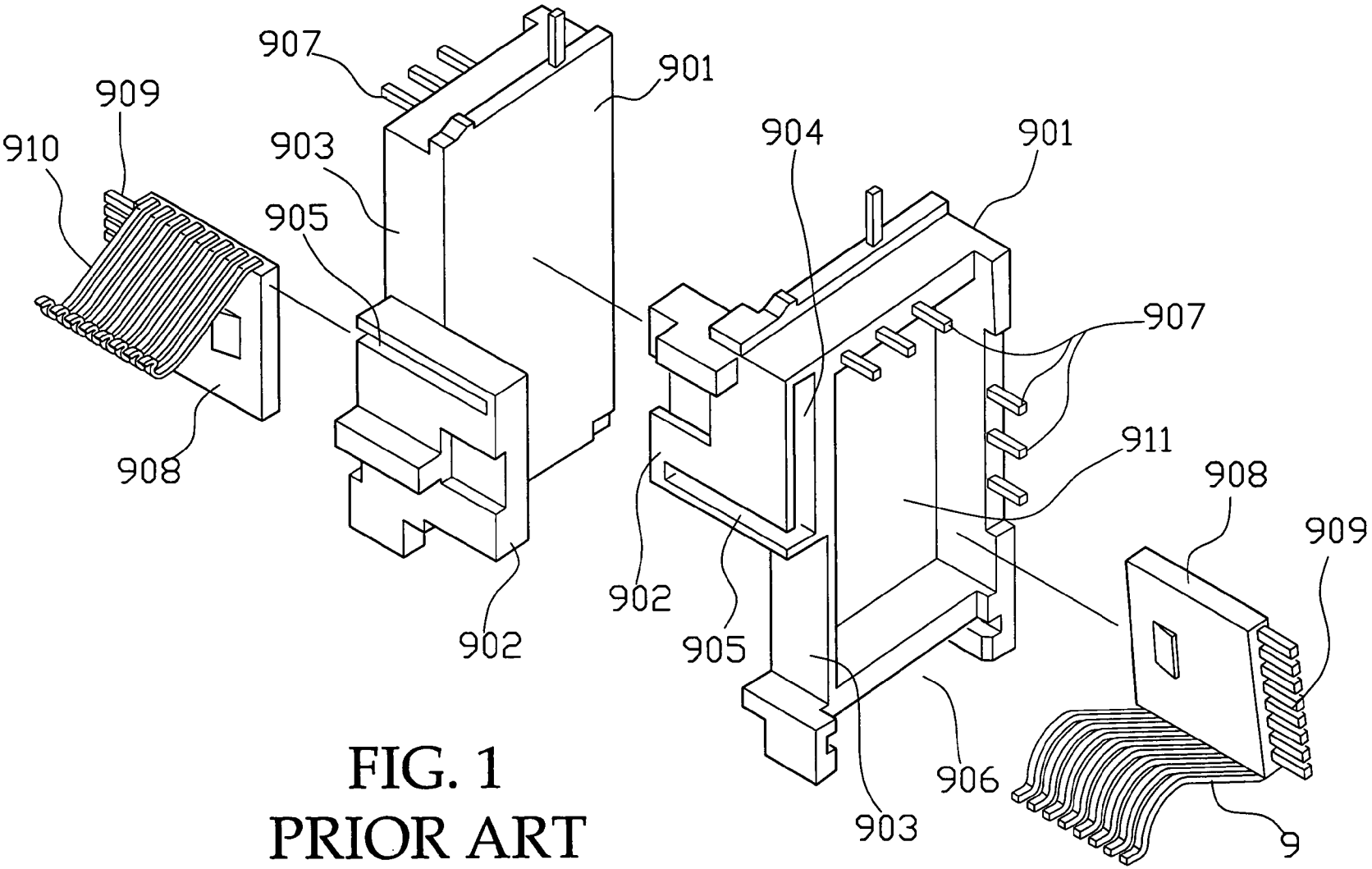
FIG. 1 PRIOR ART
FIG. 1 is an anatomic perspective view of a conventional communication module in a stacked connector.
Figure 2:
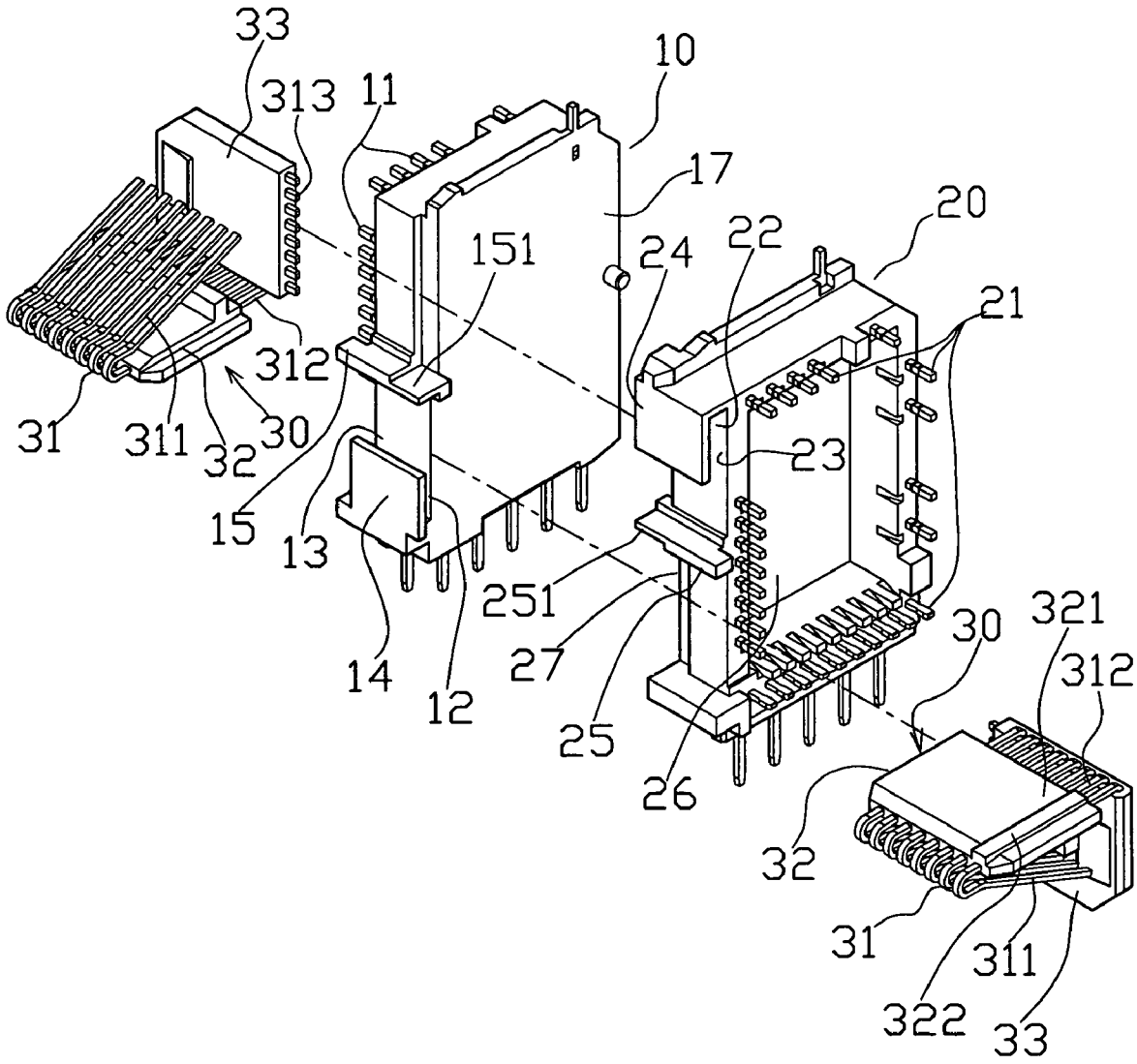
FIG. 2 is an anatomic perspective view of the present invention.
Figure 3:
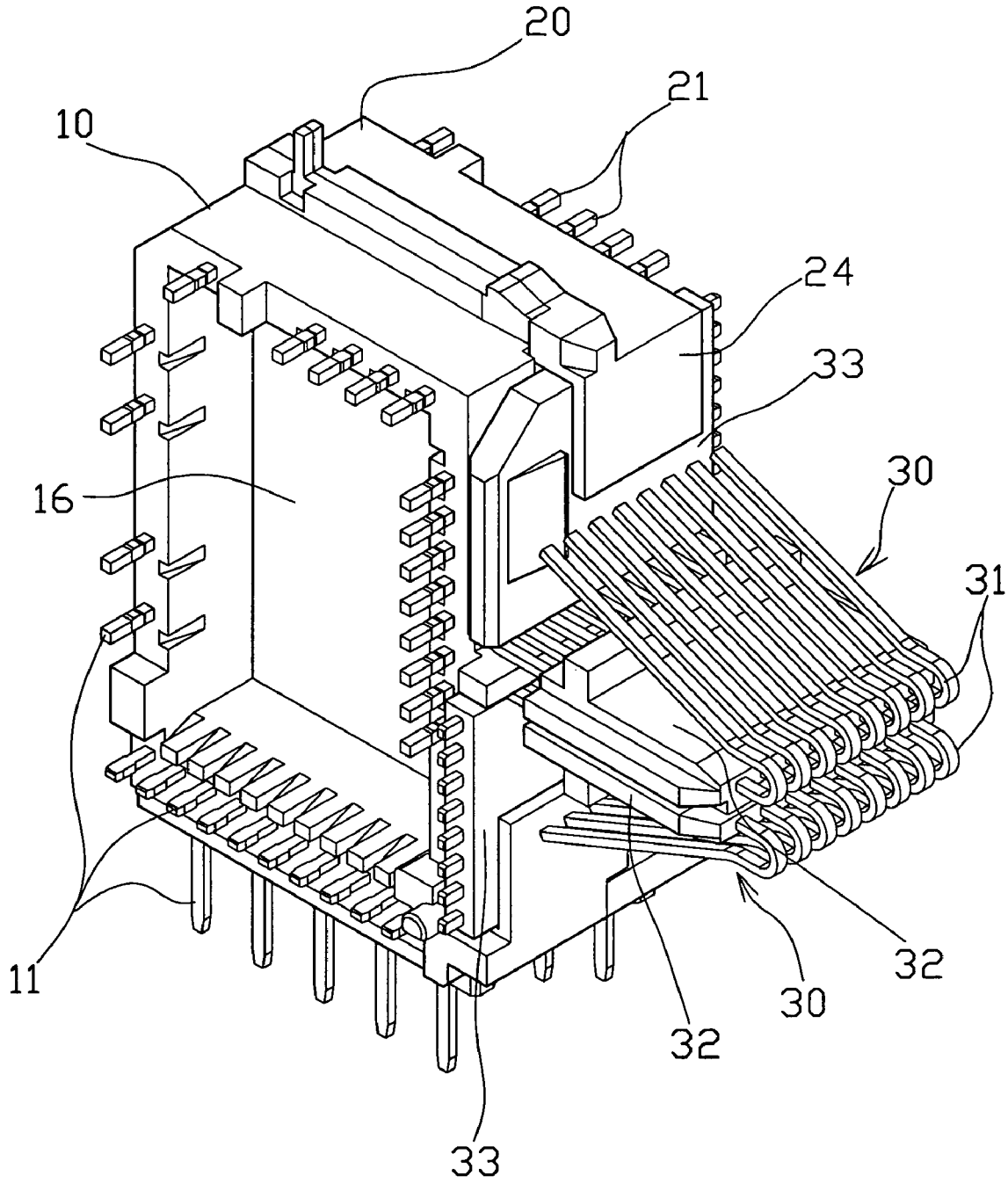
FIG. 3 is a perspective view showing assembling of present invention.

Referring to FIGS. 2 and 3, the communication module of the present invention comprises a left and a right base part 10 and 20 mutually connecting and symmetrically arranged, and being made of insulating material and being shaped with pins 11 and 21 embedded therein to be connected with circuit boards, the pins 11 and 21 are extended respectively out of side surfaces and bottom surfaces of the left and the right base parts 10 and 20.

Figure 4A:
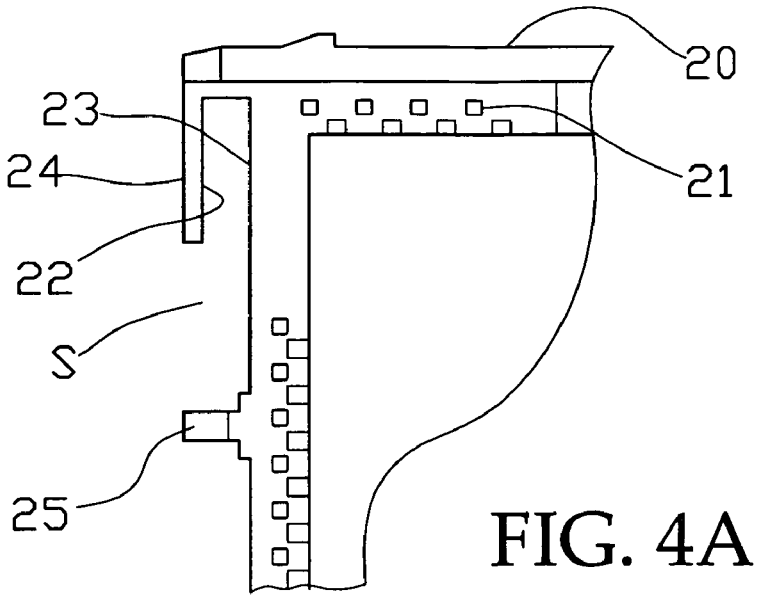
FIG. 4A is an enlarged side view showing an A part in FIG. 4.
Figure 4:
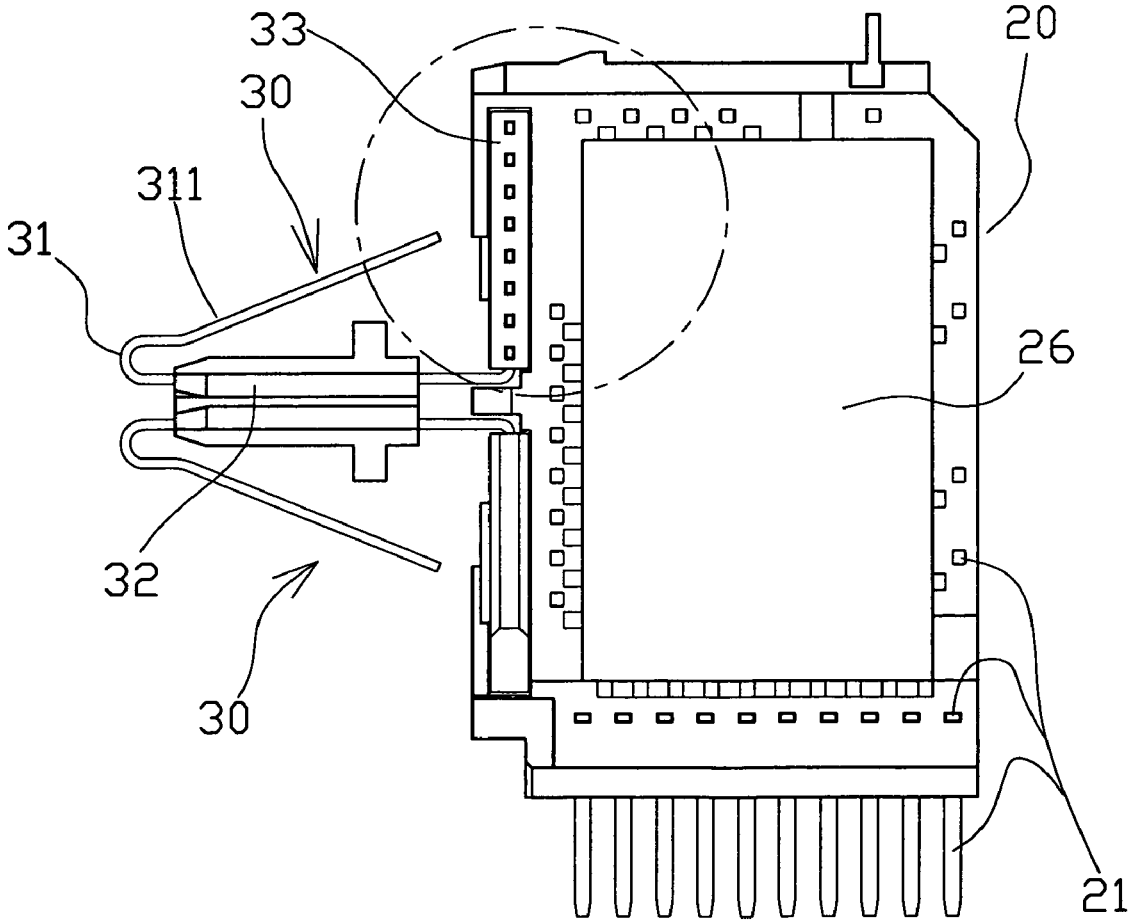
FIG. 4 is a side view of the present invention.

Two engaging grooves 12 and 22 are provided respectively at the bottom of the left base part 10 and at the top of the right base part 20; the engaging grooves 12 and 22 are formed from front walls 13, 23 of the left base part 10 and the right base part 20 and two plain plates 14, 24 respectively extending vertically at the bottom of the left base part 10 and at the top of the right base part 20 as are depicted in FIGS. 2 and 4. The two plain plates 14, 24 extend respectively from the bottom of the left base part 10 and the top of the right base part 20 for about ¼ the height of any of the these base parts 10, 20, thus an opened space "s" is formed to be convenient for assembling of connecting pin sets 30. The engaging grooves 12 and 22 are inserted therein with vertical plates 33 on the connecting pin sets 30 to make connecting of the inner sides 17, 27 of the these base parts 10, 20.

Two transverse ribs 15, 25 are formed respectively at the middle of the front surfaces of the base parts 10, 20 to separate the two connecting pin sets 30. The transverse ribs 15, 25 have ends 151, 251 extending over the inner sides 17, 27 for mutually connecting.

The base parts 10, 20 respectively have interior spaces 16, 26 for mounting wave filtering coils to be insulated from abnormal voltage. These wave filtering coils are sealed in the interior spaces 16, 26 with circuit boards on lateral sides of the base parts 10, 20.

The two connecting pin sets 30 are mutually symmetrically and conversely arranged, and are composed mainly of multiple (eight each) bent and grouped metallic wire conductors 31, two inclined connecting pin sets 311 are respectively provided on the front ends of the grouped metallic wire conductors 31 to contact with plug pins, a horizontal middle section 312 of each group of metallic wire conductors 31 is enveloped thereover with a horizontal plate 32 made of insulating material, a vertical section of each group of metallic wire conductors 31 is enveloped thereover with a vertical plate 33 also made of insulating material, pins 313 on the tailing end of each group of metallic wire conductors 31 protrude out of a lateral side of each vertical plate 33 and can be connected with a circuit board. The two vertical plates 33 on the connecting pin sets 30 are inserted respectively into the two engaging grooves 12, 22 provided at the front sides of the left and the right base parts 10, 20, in this way, assembling of the base structure of the entire communication module can be completed, such as are shown in FIGS. 3 and 4. When the circuit boards are mounted on the two lateral sides of the base structure, and the pins 11, 21 and 313 are welded to the circuit boards, thus the entire communication module is completed.

Figure 5:
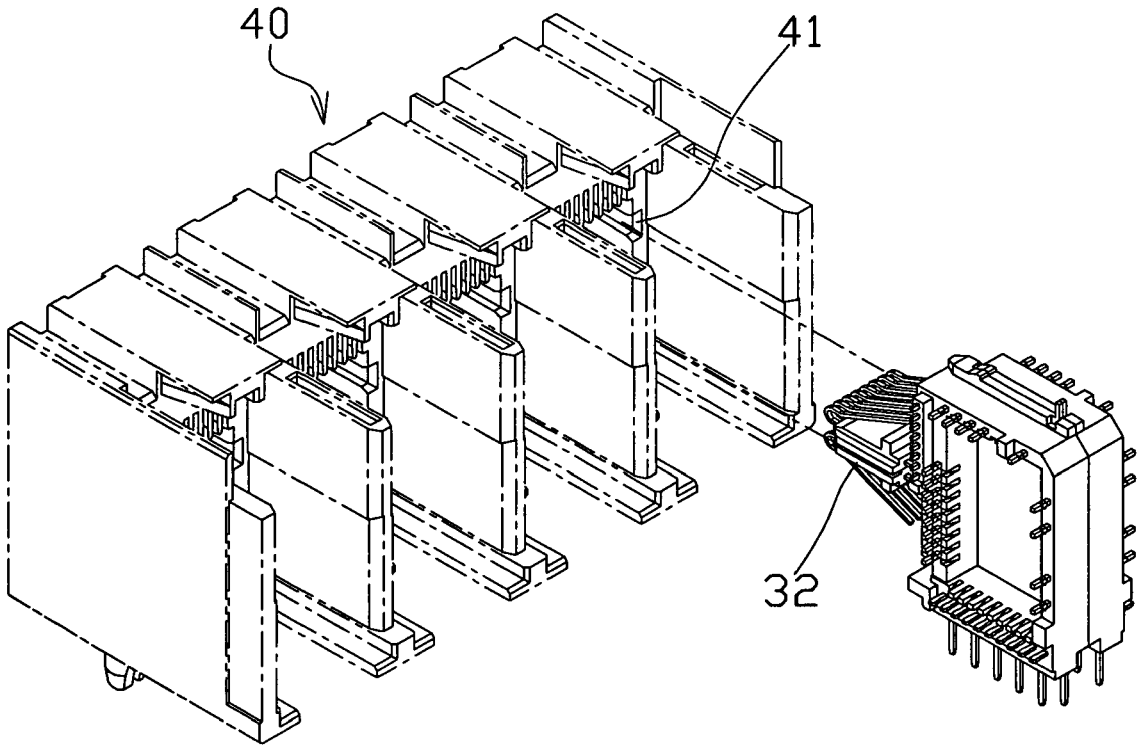
FIG. 5 is a schematic perspective view showing that the present invention is assembled in a seat.

As shown in FIG. 5, the communication module of the present invention is mounted in a socket 40 of the seat for a stacked connector (as shown by dotted lines), then a shielding housing is used to cover the socket seat 40, and the stacked connector is formed.

A contact surface 321 of the horizontal plate 32 on each of the connecting pin sets 30 has on its one lateral side a stop strip 322 to help positioning in assembling of the connecting pin sets 30.

It is worth noticing that the base structure provided in the present invention uses the two engaging grooves 12, 22 symmetrically arranged and provided at the front sides of the left and the right base parts 10, 20 to assemble the two vertical plates 33 of the two connecting pin sets 30, this makes the operation of assembling easier and faster, thus can increase the rate of production and ratio of superiority, and the cost of production can be lowered.

And more, the present invention has pins embedded in the left and the right base parts 10, 20, it no more needs to have the two lower pin boards mounted in the lower receiving recesses 906 as is the case of the conventional communication module. Thereby this structure is more stable than the conventional structure and is not subjected to separating.

Moreover, the connecting pin sets 30 of the present invention has thereon horizontal plates 32 to separate the connecting pin sets 30, there is no worry of having conductive things dropped on them.

And as shown in FIG. 5, when the communication module of the present invention are assembled on the seat 40 of the connector, by virtue that the two horizontal plates 32 on the two connecting pin sets 30 slide along sliding ways 41 formed in the sockets of the seat 40 for assembling, the structure of an entire stacked connector having the communication module is firmer, the structure can afford inserting of two plugs from the front face of the connector.

Having now particularly described and ascertained the novelty and improvement of the base structure for a communication module provided in the present invention and in what manner the same is to be performed, what we claim will be declared in the claims followed.

The invention claimed is:

1. A base structure for a communication module and for use in a stacked connector inserted with RJ-45 network-line plugs, said base structure comprises:

a left and a right base part mutually connecting and symmetrically arranged, being made of insulating material and being shaped with pins embedded therein to be connected with circuit boards, said pins are extended respectively out of side surfaces and bottom surfaces of said left and said right base parts; two engaging grooves are provided respectively at a bottom of said left base part and at a top of said right base part;

two connecting pin sets mutually symmetrically and conversely arranged, and composed of a plurality of bent and grouped metallic wire conductors, two inclined connecting pin sets are respectively provided on front ends of said grouped metallic wire conductors to contact with plug pins, a horizontal middle section of each group of said metallic wire conductors is enveloped thereover with a horizontal plate made of insulating material, a vertical section of each group of said metallic wire conductors is enveloped thereover with a vertical plate also made of insulating material, pins on a tailing end of each group of said metallic wire conductors protrude out of a lateral side of each of said vertical plates; said two vertical plates on said connecting pin sets are inserted respectively into said two engaging grooves provided at front sides of said left and said right base parts, in this way, inner sides of said left and said right base parts are mutually connected, and assembling of said base structure of said communication module is completed.

2. The base structure for a communication module as claimed in claim 1, wherein said engaging grooves are formed from front walls of said left and said right base parts and two plain plates respectively extending vertically at said bottom of said left base part and at said top of said right base part, said plain plates extend for about ¼ of the height of any of said left and said right base parts, thus an opened space is formed at the middle of said left and said right base parts.

3. The base structure for a communication module as claimed in claim 1, wherein two transverse ribs are formed respectively at the middle of front surfaces of said left and said right base parts to separate said two connecting pin sets.

4. The base structure for a communication module as claimed in claim 3, wherein said transverse ribs have ends extending over said inner sides of said left and said right base parts for mutually connecting.

5. The base structure for a communication module as claimed in claim 1, wherein said left and said right base parts respectively have interior spaces for mounting wave filtering coils to be insulated from abnormal voltage; said wave filtering coils are sealed in said interior spaces with circuit boards on lateral sides of said left and said right base parts after assembling.

6. The base structure for a communication module as claimed in claim 1, wherein a contact surface of said horizontal plate on each of said connecting pin sets has on its one lateral side a stop strip to help positioning in assembling of said connecting pin sets.

* * * * *